United States Patent [19]

Sabranski

[11] Patent Number: 4,497,253

[45] Date of Patent: Feb. 5, 1985

[54] ARMOR-PIERCING PROJECTILE

[75] Inventor: Udo Sabranski, Willich, Fed. Rep. of Germany

[73] Assignee: Rheinmetall GmbH, Duesseldorf, Fed. Rep. of Germany

[21] Appl. No.: 237,395

[22] Filed: Feb. 4, 1981

[30] Foreign Application Priority Data

Feb. 5, 1980 [DE] Fed. Rep. of Germany ..... 3004047

[51] Int. Cl.[3] ..... F42B 11/22

[52] U.S. Cl. ..... 102/476; 102/517

[58] Field of Search ..... 102/305–310, 102/378, 473, 475, 476, 501, 517–519, 211

[56] References Cited

U.S. PATENT DOCUMENTS

| | | | |
|---|---|---|---|
| 373,387 | 11/1887 | Butler | 102/519 |
| 3,370,535 | 2/1968 | Permutter | 102/518 |
| 3,750,582 | 8/1973 | Kintish et al. | 102/476 |
| 3,855,932 | 12/1974 | Parker et al. | 102/378 |
| 4,063,512 | 12/1977 | Davis | 102/476 |
| 4,102,271 | 7/1978 | Bethmann | 102/476 |
| 4,108,072 | 8/1978 | Trinks et al. | 102/518 |
| 4,291,627 | 9/1981 | Ziemba et al. | 102/211 |

FOREIGN PATENT DOCUMENTS

| | | | |
|---|---|---|---|
| 1002092 | 3/1952 | France | 102/476 |
| 1090957 | 4/1955 | France | 102/476 |

*Primary Examiner*—Harold J. Tudor

[57] ABSTRACT

An armor-piercing projectile having a hard core and a hollow charge disposed in front of the hard core with respect to the direction of flight. A proximity fuse is arranged in the projectile and is adapted to effect an ignition of the hollow charge prior to the impacting of the armor-piercing projectile on the target.

5 Claims, 2 Drawing Figures

FIG. 1
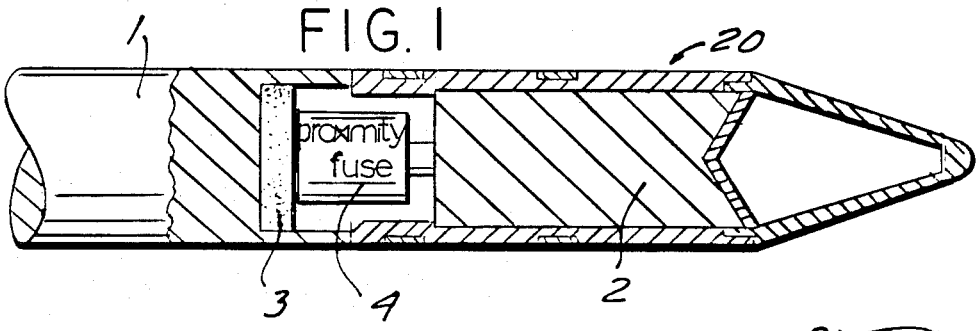
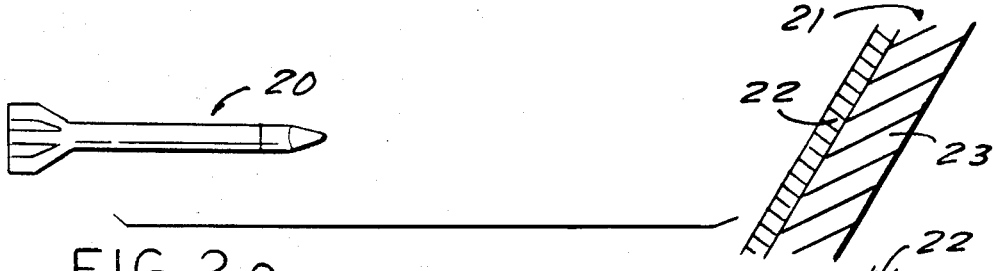
FIG. 2a
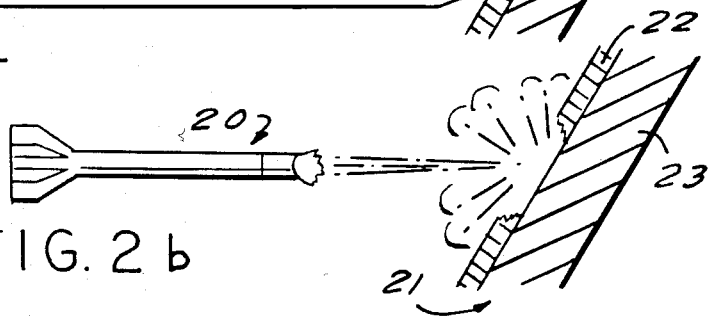
FIG. 2b
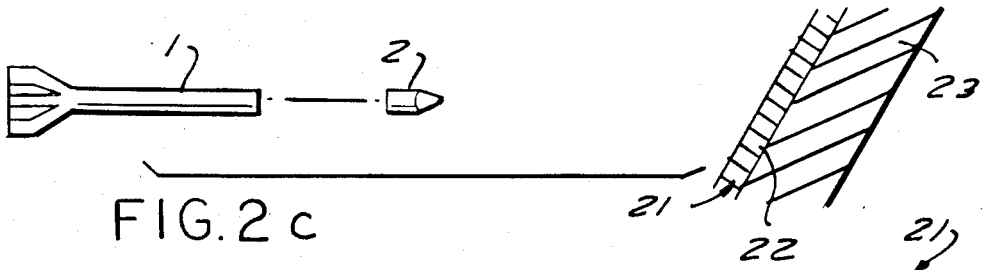
FIG. 2c
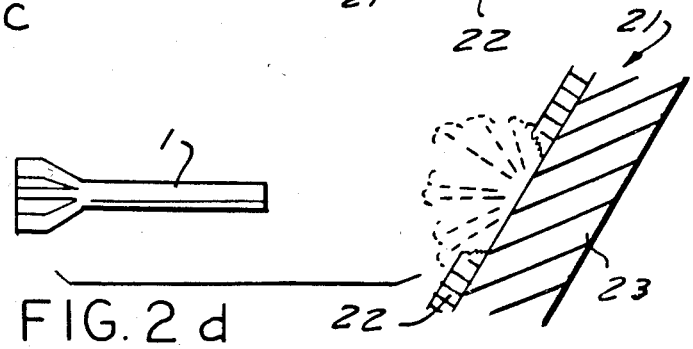
FIG. 2d

ARMOR-PIERCING PROJECTILE

BACKGROUND OF THE INVENTION

The invention relates to an armor-piercing projectile. French Pat. No. 1002092 describes armor-piercing projectiles which have a hollow charge portion arranged in front of a hard core inside the projectile relative to the direction of flight of the projectile. Such known projectiles have good armor piercing capabilities with respect to conventional armor plating. The ignition of the hollow charge in these known armor-piercing projectiles is effected by means of an impact igniter, disposed in the head of the projectile, which releases the ignition process upon impacting on the target.

However, with respect to the more modern armor platings, which are referred to in the art as "active armor", the armor-piercing capability of the aforedescribed known armor-piercing projectile has been found insufficient, so that targets having such "active armor" can not be effectively combatted with these conventional armor-piercing projectiles.

SUMMARY OF THE INVENTION

It is an object of this invention to provide a new type of armor-piercing projectile which can be effectively used against targets being protected by so-called "active armor" plating.

BRIEF DESCRIPTION OF THE DRAWINGS

In the accompanying drawings, which illustrate two of the possible embodiments of the invention;

FIG. 1 is schematic longitudinal axial cross-sectional view of a projectile in accordance with this invention;

FIGS. *2a–2d* are schematic representations of projectiles, in accordance with this invention, in flight, illustrated in different positions relative to a target protected by "active armor" plating.

DETAILED DESCRIPTIONS

The armor-piercing projectile comprises a hollow charge 2, arranged in front of the hard core 1, with respect to the flight direction of the projectile. In contradistinction to the conventional armor-piercing projectiles of this type, the projectile of this invention is equipped with a proximity fuse or igniter instead of the conventional target impact or target contact igniter or fuse. This proximity fuse or igniter can be constructed as a capacitive proximity igniter. This proximity fuse or igniter causes an ignition of the hollow-charge 2 of the projectile 20, at a predetermined distance from the target 21 (see FIGS. *2a* and *2b*), that is prior to the projectile 20 reaching the target 21. The spike formed by the detonating hollow charge is thereby caused to impinge on the outer layer 22 of the "active armor" plating consisting of layers 22 and 23 of the target 21. Due to the impact of the hollow charge spike the layer 22 of the "active armor", which may consist of an explosive material, is caused to detonate and therefore can no longer inhibit the effectiveness of the hard core 1 of the projectile, which follows in the direction of flight, when it reaches the target 21. In this way an undisturbed penetration of the remaining layer 23 of the "active armor" by the hard core 1 of the projectile 20 is made possible.

The hard core 1 of the projectile 20 consists advantageously of a heavy metal, for example, a tungsten or uranium alloy or compound. Sintered bodies made from the aforementioned substances have been found to be particularly suitable. As is already known, the penetration capacity of the hard core can be increased by forming the hard core out of a plurality of component elements, which can, for example, be of annular configuration and which can be arranged one behind the other in the axial direction.

The hollow charge 2 of the projectile 20 is advantageously formed as a flat conically shaped hollow charge having, a copper, nickel-aluminum or also zirconium insert. Thereby a particularly favorable influence on the in general sluggish explosive material of the active armor is attained.

In an advantageous further embodiment of the invention (FIGS. *2c* and *2d*) the hollow charge portion 2 and hard core 1 of the projectile 20 are constructed to be separable during flight which is effected preferably by providing an expulsion charge 3 between the hard core 1 and the hollow charge 2, which is advantageously activated by the proximity fuse 4 at a predetermined distance from the target. When the projectile has sufficiently approached the to be combatted target 21 the hollow charge 2 is explosively expelled by the expulsion charge 3 and precedes the hard core 1 in the direction of flight towards the to be combatted target. By the explosion of the hollow charge at the target the effect of the "active armor" is disposed of, so that the timely following hard core 1 can pass through the remaining layer 23 without difficulty.

The armor piercing projectile can preferably be formed as sabot-propelled, sub-caliber projectile and is particularly suitable to be fired out of weapons having smooth bore gun barrels.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

I claim:

1. An armor-piercing projectile having a hard core containing portion and a hollow charge containing portion arranged in front thereof with respect to the direction of flight, comprising proximity fuse means which are adapted to effect an ignition of the hollow charge prior to the impacting of the armor-piercing projectile on the target; said two portions being separable from each other during flight of the projectile; and including an explosive expulsion charge disposed in said projectile between said hard core containing portion and said hollow charge containing portion, said proximity fuse being operatively connected to said expulsion charge which is adapted to expel said hollow charge containing portion after being ignited due to the activation of the proximity fuse means.

2. The armor-piercing projectile as set forth in claim 1, wherein said hard core is made out of heavy metal.

3. The armor-piercing projectile as set forth in claim 2, wherein said hard core is made out sintered material.

4. The armor-piercing projectile as set forth in claim 3, wherein said hard core is made out of a material selected from the group consisting of tungsten and uranium alloys.

5. The armor-piercing projectile as set forth in claim 4, wherein said hard core is made out of a plurality of parts.

* * * * *